US009745714B2

(12) United States Patent
Lubbers

(10) Patent No.: US 9,745,714 B2
(45) Date of Patent: Aug. 29, 2017

(54) EARTH MOVING IMPLEMENT

(71) Applicant: Randy Lubbers, Hutchinson, KS (US)

(72) Inventor: Randy Lubbers, Hutchinson, KS (US)

( * ) Notice: Subject to any disclaimer, the term of this patent is extended or adjusted under 35 U.S.C. 154(b) by 0 days.

(21) Appl. No.: 15/153,611

(22) Filed: May 12, 2016

(65) Prior Publication Data

US 2016/0258131 A1 Sep. 8, 2016

(51) Int. Cl.

| | |
|---|---|
| ***E02F 3/64*** | (2006.01) |
| ***E02F 3/65*** | (2006.01) |
| ***E02F 3/76*** | (2006.01) |
| ***E02F 9/22*** | (2006.01) |

(52) U.S. Cl.

CPC ..... *E02F 3/6463* (2013.01); *E02F 3/651* (2013.01); *E02F 3/652* (2013.01); *E02F 3/654* (2013.01); *E02F 3/7663* (2013.01); *E02F 9/2275* (2013.01)

(58) Field of Classification Search

CPC ..... E02F 3/6463; E02F 3/6472; E02F 3/7663; E02F 3/7672

USPC ..... 172/799.5, 684.5; 37/408

See application file for complete search history.

(56) References Cited

U.S. PATENT DOCUMENTS

| | | | | | |
|---|---|---|---|---|---|
| 646,769 | A | | 4/1900 | Swarts | |
| 1,258,238 | A | | 3/1918 | Mougin | |
| 1,911,511 | A | * | 5/1933 | Jordan | E02F 3/6463 37/417 |
| 1,958,195 | A | | 5/1934 | Le Bleu | |
| 1,982,219 | A | | 11/1934 | McAllister | |
| 2,271,631 | A | * | 2/1942 | Davidson | E02F 3/6463 37/417 |
| 2,348,910 | A | * | 5/1944 | Kadz | E02F 3/6463 37/436 |
| 2,923,074 | A | * | 2/1960 | Tucker | E02F 3/6463 37/441 |
| 3,097,440 | A | * | 7/1963 | Schmidt | E02F 3/6463 37/428 |
| 3,154,868 | A | * | 11/1964 | Buchli | E02F 3/6463 298/11 |
| 3,200,520 | A | * | 8/1965 | Nichoils | E02F 3/6463 37/427 |
| 3,330,054 | A | * | 7/1967 | Martin | E02F 3/6481 37/428 |

(Continued)

FOREIGN PATENT DOCUMENTS

| | | | | |
|---|---|---|---|---|
| CA | 2505562 A1 * | 10/2006 | ..... | E02F 3/6463 |

*Primary Examiner* — Matthew D Troutman

(74) *Attorney, Agent, or Firm* — Kenneth H. Jack; Davis & Jack, L.L.C.

(57) ABSTRACT

An earth moving implement incorporating left and right rails; a bucket between the left and right rails; left and right pivot axles interconnecting the bucket and the left and right rails for rotating the bucket between earth scooping and blading position; left and right arms extending leftwardly and rightwardly from the bucket's left and right ends, the arms' proximal ends underlying the left and right rails; left and right linear motion actuators respectively positioned leftwardly and rightwardly from the left and right rails, the actuators having bucket ends pivotally attached to the left and right arms; left and right columns rigidly positioned at the rails' rearward ends, the actuators' base ends being pivotally attached to the left and right columns for rotating the bucket; a plurality of wheels rollably mounted to the rails' rearward ends; and a towing tongue rigidly extending from the rails' forward ends.

15 Claims, 5 Drawing Sheets

(56) References Cited

U.S. PATENT DOCUMENTS

| | | | | | |
|---|---|---|---|---|---|
| 3,474,550 | A | | 10/1969 | Frank | |
| 3,651,589 | A | * | 3/1972 | Reynolds | E02F 3/64 37/414 |
| 3,672,460 | A | | 6/1972 | Takata | |
| 4,189,009 | A | | 2/1980 | Welch | |
| 4,343,100 | A | * | 8/1982 | York | E02F 3/6427 37/431 |
| 4,373,603 | A | | 2/1983 | Nelson | |
| 4,383,380 | A | | 5/1983 | Miskin | |
| 4,398,363 | A | * | 8/1983 | Miskin | E02F 3/64 37/429 |
| 4,490,929 | A | * | 1/1985 | Lucas | E02F 3/64 172/799.5 |
| 4,553,608 | A | | 11/1985 | Miskin | |
| 5,074,061 | A | * | 12/1991 | Thompson | E02F 3/65 172/196 |
| 5,407,014 | A | | 4/1995 | Tranmer | |
| 5,535,832 | A | | 7/1996 | Benoit | |
| 5,833,012 | A | | 11/1998 | Pierce et al. | |
| 6,061,932 | A | | 5/2000 | Rowley | |
| 6,112,828 | A | | 9/2000 | Leal | |
| 6,328,115 | B1 | | 12/2001 | Carter, Jr. | |
| 6,352,126 | B1 | | 3/2002 | Brown | |
| 6,360,827 | B1 | | 3/2002 | Clary | |
| 6,672,401 | B1 | | 1/2004 | Crowley, II | |
| 7,021,398 | B1 | * | 4/2006 | Marshall | E02F 3/7677 172/788 |
| 7,077,216 | B2 | | 7/2006 | Juncker | |
| 7,165,346 | B2 | | 1/2007 | Miskin | |
| 7,673,700 | B2 | | 3/2010 | Moyna | |
| 7,926,583 | B2 | | 4/2011 | Newnam | |
| 7,971,886 | B2 | | 7/2011 | Neudorf et al. | |
| 8,079,425 | B1 | | 12/2011 | VanKooten et al. | |
| 8,127,474 | B2 | | 3/2012 | Phillips | |

* cited by examiner

EARTH MOVING IMPLEMENT

FIELD OF THE INVENTION

This invention relates to mobile earth moving equipment and machinery. More particularly, this invention relates to such machinery which is adapted for forward pulling or towing by a heavy tractor vehicle.

BACKGROUND OF THE INVENTION

Earth working or earth moving implements which are adapted for towing in the manner of a wheeled trailer behind a heavy tractor vehicle are known. Where the earth to be worked by such implements comprises an irregular gravel or dirt road surface, bucket scooping and blade screeding operations may be advantageously and alternatively performed upon such surface in order to smooth and level the surface. However, such known earth working implements are commonly incapable of multiply functioning for alternatively scooping and collecting earth or dirt during forward travel of the implement, dumping such collected dirt, and blading or screeding the dirt as the implement moves forwardly.

The instant inventive earth moving implement advantageously provides for and facilitates such multiple and alternative earth working functions by specially configuring bucket side wall components in relation to rail components, and by specially mounting actuators for pivotably moving the bucket element between scooping and blading or screeding positions.

BRIEF SUMMARY OF THE INVENTION

Foundational structural components of the instant inventive earth moving implement comprise rigidly positioned left and right rails. In a preferred embodiment, such rails comprise heavy duty steel beams and extend along front to rear or longitudinal axes.

A further structural component of the instant earth moving implement comprises a bucket defining a forwardly opening earth collecting concavity, the bucket's interior being downwardly bounded by a floor and rearwardly bounded by a rear wall. In the preferred embodiment, the bucket has a lateral dimension spanning between inner left and inner right walls, such dimension allowing the bucket to be closely received between the left and right rails.

Left and right axles are provided for pivotally interconnecting the bucket and the left and right rails. In the preferred embodiment, the left and right axles facilitate alternative rotations and counter-rotations of the bucket toward a forwardly oriented earth scooping position and toward a substantially downwardly oriented earth blading or screeding position. Upon completion of a rotating motion of the bucket about such axles to the earth scooping position, the floor of the bucket preferably angles slightly downwardly with respect to the bucket's pivot axis. Alternatively, upon counter-rotation of the bucket to its blading or screeding position, such floor further angles sharply downwardly with respect to the pivot axis.

Further structural components of the instant inventive earth moving implement comprise a first pair of or left and right linear motion actuators, each of such actuators having a base end and a bucket attachment end. In the preferred embodiment, such actuators' bucket end attachments comprise left and right arms which at least extend laterally from the bucket's floor to respectively protrude leftwardly and rightwardly from elevations underlying the left and right rails. The bucket attachment ends of the first pair of actuators preferably comprise pivoting clevis joints positioned at the distal ends of such left and right arms. In a preferred embodiment, the left and right linear motion actuators comprise two way hydraulic rams. Suitably, though less desirably, the left and right linear motion actuators may alternatively comprise manually actuated jack screw actuators, electric motor driven ball screw actuators, or manual or motor driven rack and pinion actuators.

Further structural components of the instant inventive earth moving implement comprise a first pair of or left and right actuator mounts. Such mounts preferably comprise left and right columns which are respectively rigidly positioned at rearward ends of the left and right rails. In a preferred embodiment, the base ends of the left and right linear motion actuators are respectively pivotally attached by pin and clevis joints to upper ends of such left and right mounts. Accordingly, the pivoting base and bucket end attachments of the implement's first pair of actuators allows their alternative extending and retracting motions to drive the bucket's rotating and counter-rotating motions. The actuators' base end mounts are preferably stepped or laterally displaced leftwardly and rightwardly from left and right vertical and longitudinally extending planes which include the left and right rails. Such laterally stepped positionings of the base mounts advantageously longitudinally align the actuators' thrust vectors with arm attachment points which reside outwardly from or leftwardly and rightwardly from the left and right rails.

Further structural components of the instant inventive earth moving implement comprise a rearward plurality of wheels which are rollably connected to the left and right rails' rearward ends, and forward towing means fixedly connected to such rails' forward ends. In operation of the instant inventive earth moving implement, extending actuations of the left and right linear motion actuators rotate the bucket counter-clockwise toward its earth scooping position. Alternatively, retracting operation of the actuators counter-rotates the bucket in the clockwise direction to its earth blading or screeding orientation. Such clockwise bucket motion may alternatively serve an earth dumping function.

In a preferred embodiment, the wheels' operative connection to the left and right rails' rearward ends comprises a first rigid cross-brace, which spans laterally between rearward ends of the left and right rails, in combination with a pair of, or left and right, pivot legs. In the preferred embodiment, proximal ends of the left and right legs are hingedly or pivotally mounted to such cross brace, the distal ends of the legs extending rearwardly therefrom.

A second pair of columnar actuator mounts are preferably fixedly attached to the first cross brace, such columns extending upwardly from the legs' proximal pivot mounts. To facilitate pivoting articulation of the legs, a second pair of linear motion actuators, preferably a second left and a second right hydraulic ram, are mounted in triangulating relationships with the left and right legs and their columnar actuator mounts. Varying extending and retracting operations of the second pair of hydraulic rams may raise, lower, tilt, and counter-tilt the bucket with respect to the ground.

Accordingly, objects of the instant invention include the provision of an earth moving implement which incorporates structures as described above, and which arranges those structures in relation to each other in manners described above for the performance of beneficial functions described above.

Other and further objects, benefits, and advantages of the instant invention will become known to those skilled in the art upon review of the Detailed Description which follows, and upon review of the appended drawings.

STATEMENT REGARDING CHARACTER OF DRAWINGS

The drawings described below are photographic in character, and the Applicant does not petition for the allowance of photographic drawings. Notwithstanding, the Applicant asserts that the drawings are such that the prosecution can be carried out without the submission of corrected drawings showing the depicted structures in black lines only. It is, therefore, permissible pursuant to MPEP §608.02(b) that the drawings be admitted for examination purposes only. Accordingly, the Applicant requests under MPEP §608.02 (b) that the drawings be admitted for examination purposes only, and that any requirement of submission of corrected drawing pages be held in abeyance until completion of examination.

DETAILED DESCRIPTION OF A PREFERRED EMBODIMENT

Figure 1:
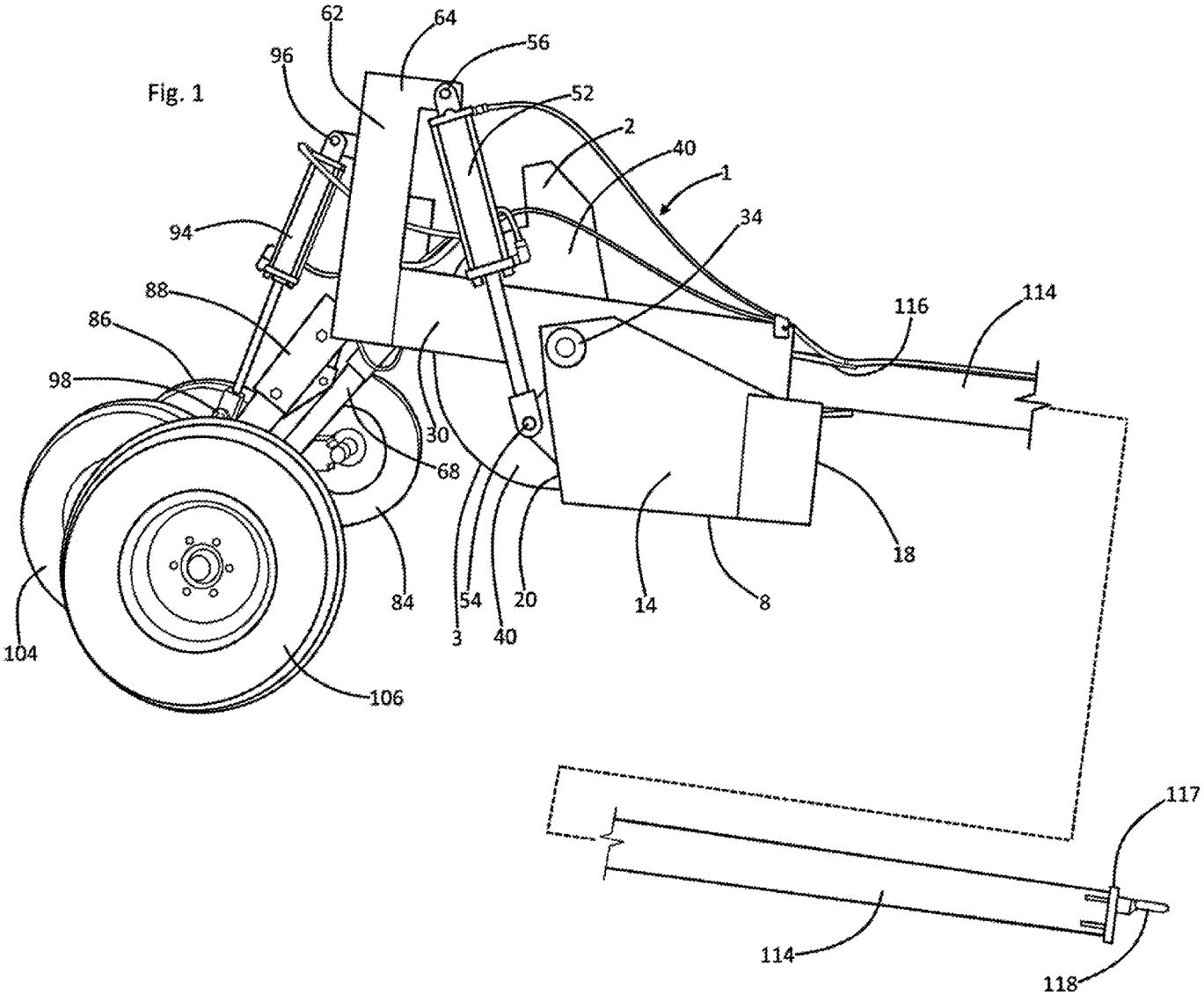
FIG. 1 is a right side view of a preferred embodiment of the instant inventive earth moving implement.
Figure 2:
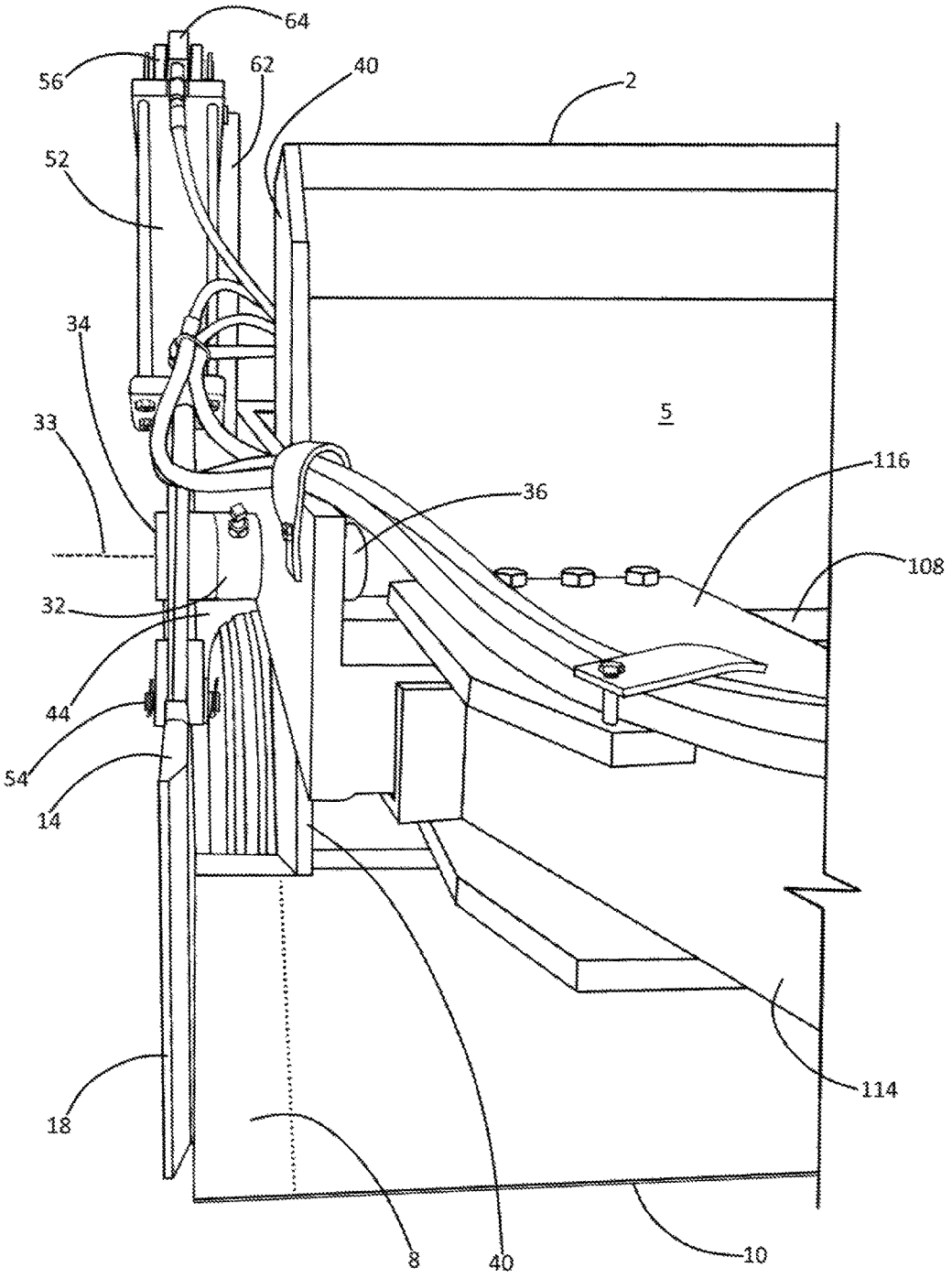
FIG. 2 is a partial right side front view of the implement of claim 1.
Figure 3:
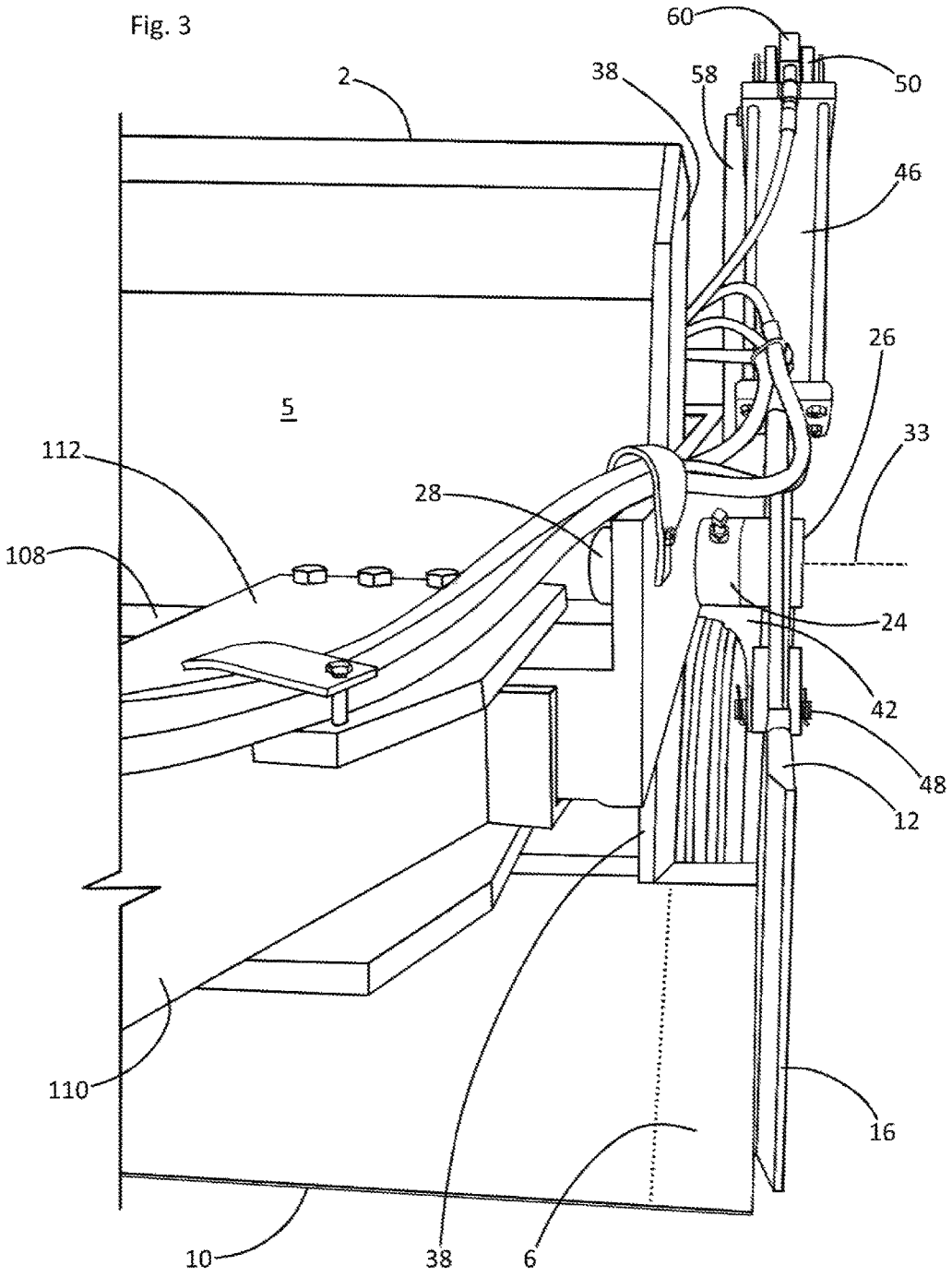
FIG. 3 is a partial left side front view of the implement of FIG. 1.

Referring now to the drawings, and in particular simultaneously to Drawing FIGS. 1-3, the instant inventive earth moving implement is referred to generally by Reference Arrow 1. The implement 1 comprises a left rail 29 and a right rail 30. A bucket 2 has a curved rear wall 3, a lower floor 4, left and right inner side walls 38 and 40, left and right arm extensions 6 and 8, and left and right outer walls 12 and 14. Such walls form a forwardly opening dirt receiving concavity 5.

In the preferred embodiment, the outer walls 12 and 14 constitute upwardly elbowing distal ends of arms 6 and 8. Also, in the preferred embodiment, the co-linear forward ends of the floor 4 and the arm extensions 6 and 8 form a laterally extending dirt cutting edge 10, and the outer walls/elbows 12 and 14 respectively form vertically extending dirt cutting edges 16 and 18. Such edges 10, 16, and 18 advantageously form a dirt cutting "U" blade which, upon rotation of the bucket 2, may nestingly receive the left and right arms 29 and 30.

Left and right pivot axles 24 and 32 having left and right outer ends 26 and 34 respectively span between the left and right rails 29 and 30 and the left and right outer walls 12 and 14. Such axles 24 and 32 facilitate, referring in particular to FIG. 1, alternative counter-clockwise rotating motions and clockwise counter-rotating motions of the bucket 2, such rotating motions being about a laterally extending pivot axis 33. In the preferred embodiment, axles 24 and 32 further include rightward and leftward extensions 28 and 36 which respectively span inwardly from the left and right rails 29 and 30 for supporting engagements with the left and right inner walls 38 and 40.

The proximal ends 6 and 8 of the bucket's left and right arms respectively underlie the lower surfaces of the left and right rails 29 and 30, and such arm ends in combination with their distal ends/outer walls 12, 14 form "U" configured left and right rail clearance spaces 42 and 44. The interstitial positionings of the left and right rails 29 and 30 between laterally paired bucket side walls (i.e., walls 12 and 38 and walls 14 and 40) advantageously dually functions to provide secure double shear journal axle support of the bucket and to allow bucket rams positioned laterally outwardly from the rails 29 and 30 to drive the bucket.

Left and right linear motion actuators, preferably in the form of two way hydraulic rams 46 and 52, have their forward and preferably downward bucket attachment ends pivotally attached to the rearward ends 19 and 20 of the bucket's left and right outer walls 12 and 14. Such pivotal attachments preferably comprise left and right pin and clevis joints 48 and 54. Such hydraulic ram linear motion actuators 46 and 52 are considered as being representative of other suitably substituted linear motion actuators such as jack screw actuators, ball screw actuators, and rack and pinion actuators (not depicted within views).

Left and right actuator mounts, preferably configured as columns 58 and 62, are preferably rigidly attached to the left and right rails 29 and 30 at such rails' rearward ends. Eye plate halves 60 and 64 of pin and clevis joints 50 and 56 are preferably welded to the upper ends of the column mounts 58 and 62 for rotating engagements with the base ends of actuators 46 and 52. As can be best seen in FIGS. 2 and 3, the left and right column mounts 58 and 62 are stepped or displaced leftwardly and rightwardly with respect to the left and right faces of the left and right rails 29 and 32. Such lateral positioning of the left and right mounts 58 and 62 advantageously allow the left and right linear motion actuators 46 and 52 to extend longitudinally (i.e., substantially perpendicularly with respect to pivot axis 33) while being positioned leftwardly and rightwardly from the rails 29 and 30. Accordingly, the special lateral positionings of the columns 58 and 62 and the outer walls 12 and 14 with respect to the rails 29 and 30 allow the bucket rams 46 and 52 to compactly function within left and right "C" spaces, the left "C" space being bounded by the left face of rail 29, the front face of column 58 and the rear edge 19 of the left outer wall 12, and the right "C" space being bounded by the right face of rail 30, the front face of column 62, and the rear edge 20 of the right outer wall 14.

Rolling support of the left and right rails 29 and 30 and the bucket 2 is preferably facilitated by a first crossbeam 66 which rigidly spans laterally between said rails' rearward ends. Left and right pivot legs 68 and 88 have forward or proximal ends which are pivotally attached to the crossbeam 66 by means of left and right pivot joints 70 and 92. A second pair of left and right columns 74 and 90 is fixedly attached to and extends upwardly from the crossbeam 66, such second columns 74 and 90 supporting at their upper ends the base ends of a second pair of left and right hydraulic rams 72 and 94.

Pivoting left and right pin and clevis joints 76 and 96 interconnect the base ends of the second hydraulic rams 72 and 94 with the upper ends of the left and right columns 74 and 90, while the lower ends of such rams pivotally attach to the left and right legs 68 and 88 by means of pin and clevis joints 78 and 98. Accordingly, the second pair of hydraulic rams 72 and 94 pivotally triangulate with respect to the left and right pivot legs 78 and 88 for variably raising and lowering such legs or alternatively raising and lowering such legs in unison.

Left and right "T" axles 82 and 102 preferably rotatably support left and right wheel pairs 84 and 86, and 104 and 106, at the distal ends of the left and right legs 78 and 88. Such "T" axles preferably longitudinally stagger their axle supports of the wheels 84, 86, and 104, 106 for enhanced stability of the bucket 2 as the implement traverses ridges or ruts in a dirt or gravel roadway.

Figure 5:
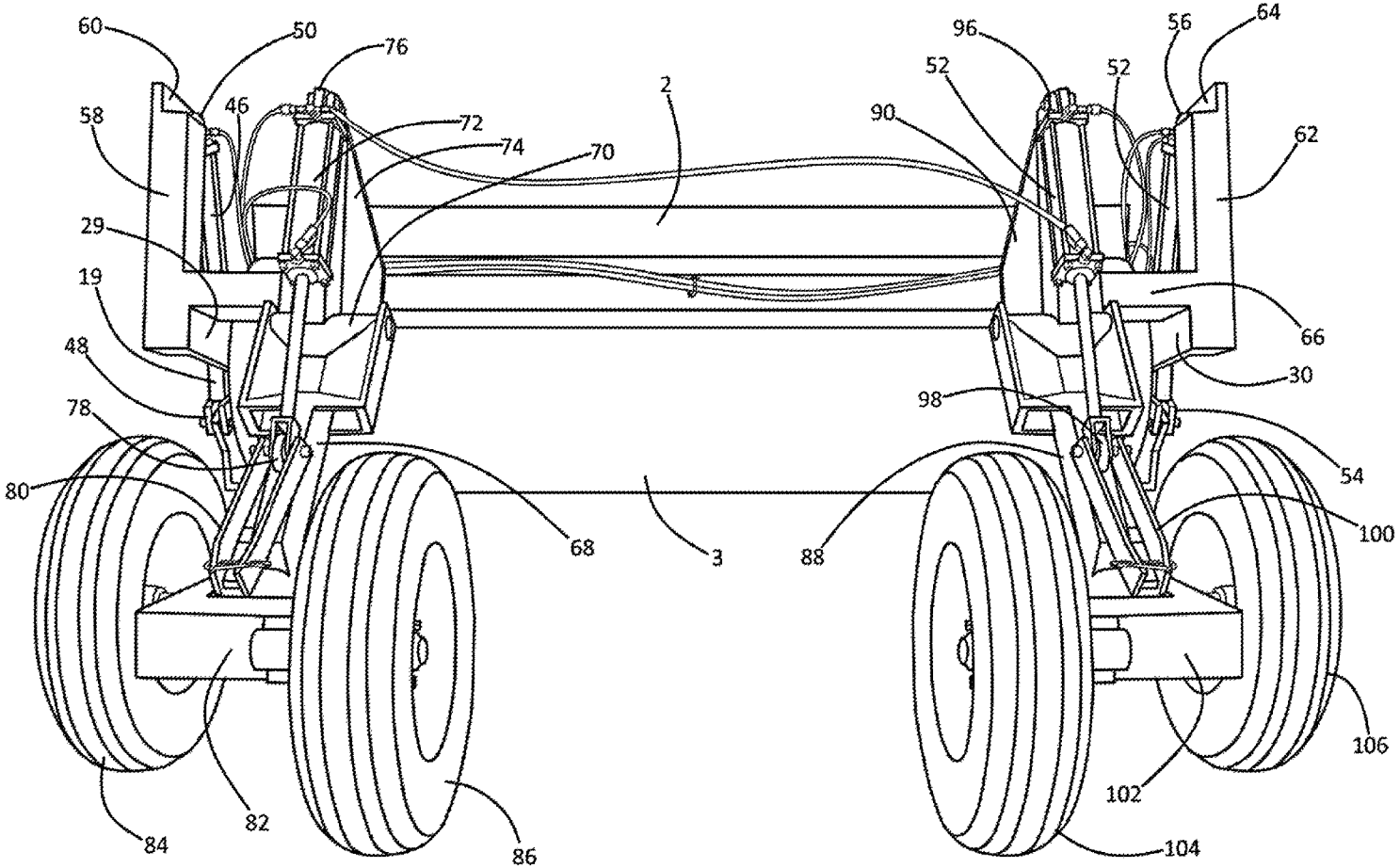
FIG. 5 is a rear view of the implement of FIG. 1.

To allow the implement 1 to be safely towed over streets and highways, left and right extension locking brackets 80 and 100 may pivot from disengaged positions (as depicted in FIG. 5) to upwardly extended locking positions (not depicted within views). Upon upward pivoting to their locked positions, the brackets 80 and 100 may advantageously secure the left and right second rams 72 and 90 at their depicted extended positions, and may mechanically secure the implement 1 at its raised position.

The instant inventive earth moving implement 1 preferably further comprises forward towing means which preferably incorporate a second crossbeam 108 which rigidly spans laterally between the forward ends of the left and right rails 29 and 30. "V" configured left and right tongue beams 110 and 114 have rearward ends rigidly mounted to the second crossbeam 108 by left and right mounting brackets 112 and 116, the forward ends of such tongue beams being rigidly forwardly interconnected by a hitch plate 117 which forms the vertex "V". A tow hitch 118 is preferably fixedly attached to and extends forwardly from plate 117.

In use of the instant inventive earth moving implement, the second left and second right two way hydraulic rams 72 and 94 may be simultaneously retracted, causing legs 68 and 88 to pivot clockwise, and causing the bucket 2 to lower toward ground level. Thereafter, and assuming that the bucket 2 is rotated counter-clockwise to the FIG. 1 scooping position, forward towing of the implement may progressively scoop dirt or gravel from a roadway into the bucket's interior space 5.

As is best shown in FIG. 1, the attachment of the pivot joint 54 to the rearward wall edge 20 is preferably positioned at an elevation below axle 32 and below pivot axis 33. Such arrangement of the bucket's pivot joints directs clockwise counter-torque experienced upon dirt scooping toward the base ends of the rams 46 and 52. Accordingly, such arrangement of the implement's pivot joints advantageously dedicates the bucket rams' greatest cross-sectional area to resistance of such counter-torque.

Figure 4:
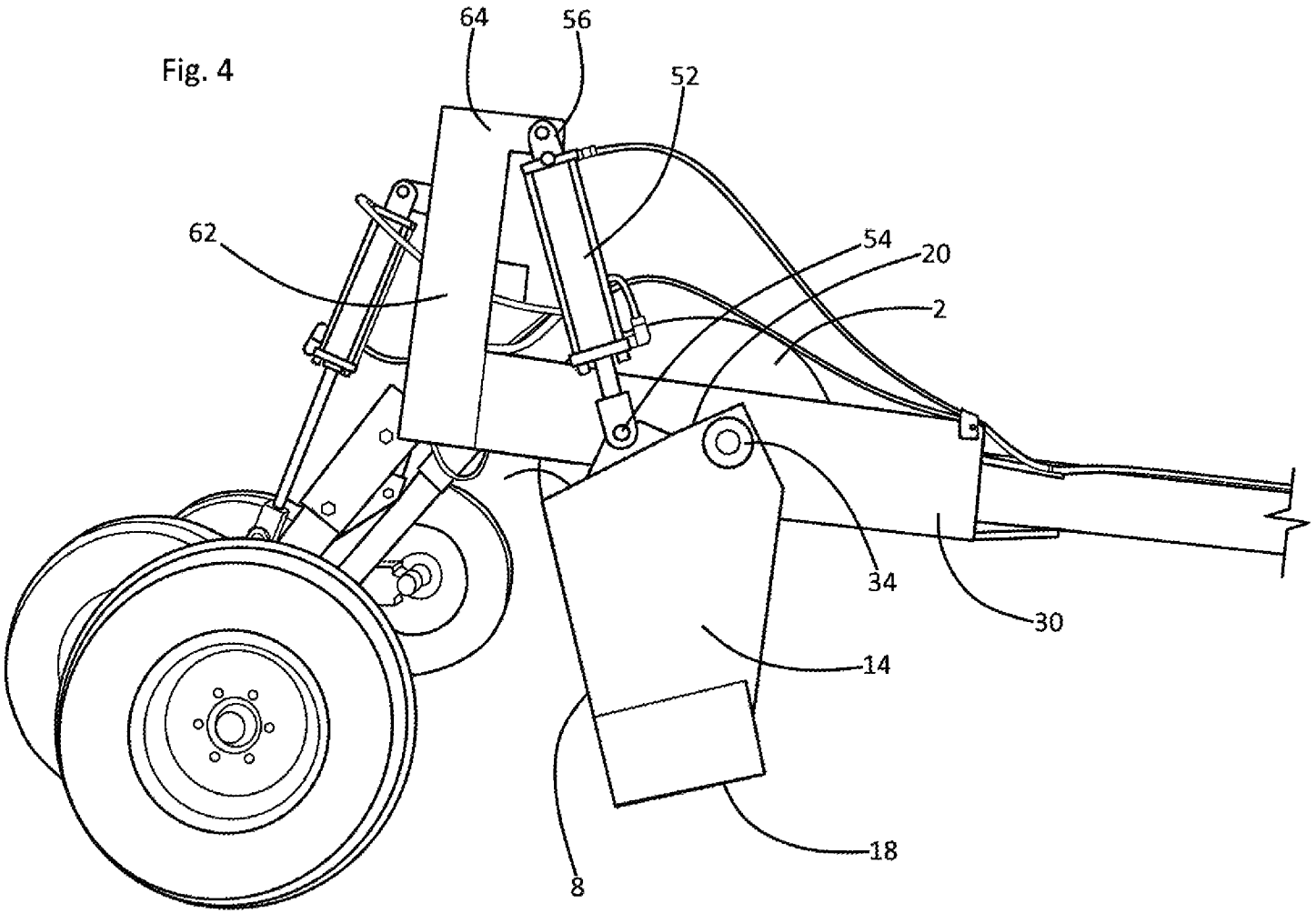
FIG. 4 redepicts the structure of FIG. 1, the view of FIG. 4 alternatively showing a bucket component counter-rotated.

Upon trailering of the implement to a desired dirt dumping location, rams 72 and 9 may be extended, causing the bucket 2 to raise to its FIG. 1 position. Thereafter, rams 48 and 52 may be retracted, causing the bucket 2 to counter-rotate in the clockwise direction about axis 33 from the dirt scooping position of FIG. 1 to the dirt dumping position of FIG. 4. Reversal of the hydraulic ram actuation steps described above may re-configure the implement for further earth scooping. At the dirt dumping orientation of the bucket 2 depicted in FIG. 4, the bucket's floor 4, 6, 8 may be alternatively utilized as an earth screeding blade.

Referring to FIG. 5, variable actuation of the second left and right rams 72 and 94 may advantageously tilt the bucket 2 leftwardly or rightwardly in order to scoop or screed along laterally sloped road or bar ditch surfaces.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. An earth moving implement comprising:

(a) left and right rails having forward and rearward ends;

(b) a bucket fitted for receipt between the left and right rails, the bucket having left and right ends;

(c) left and right pivot axles interconnecting the bucket and the left and right rails, the left and right pivot axles facilitating rotations and counter-rotations of the bucket between an earth scooping position and an earth blading position;

(d) left and right arms fixedly attached to and respectively extending leftwardly and rightwardly from the bucket's left and right ends, the left and right arms having proximal ends respectively underlying the left and right rails;

(e) left and right linear motion actuators, each of said actuators having a bucket end and a base end, said actuators being respectively positioned leftwardly and rightwardly from the left and right rails, and said actuators' bucket ends being respectively pivotally attached to the left and right arms;

(f) left and right mounts respectively fixedly positioned at the left and right rails' rearward ends, the left and right linear motion actuators' base ends being respectively pivotally attached to the left and right mounts for actuating the bucket's rotations and counter-rotations;

(g) a plurality of wheels connected operatively to the left and right rails' rearward ends; and (h) towing means connected operatively to the left and right rails' forward ends.

2. The earth moving implement of claim 1 wherein the bucket comprises an earth blading floor having left and right ends, said ends respectively comprising the left and right arms' proximal ends.

3. The earth moving implement of claim 2 wherein the bucket comprises a left outer wall and a right outer wall, wherein the left and right arms' distal ends respectively elbow upwardly leftwardly from the left rail and rightwardly from the right rail, and wherein the bucket's left and right outer walls respectively comprise said arm distal ends.

4. The earth moving implement of claim 3 wherein the left and right pivot axles respectively span between the left rail and the left outer wall and between the right rail and the right outer wall.

5. The earth moving implement of claim 4 wherein the bucket further comprises a left inner wall positioned rightwardly from the left rail and a right inner wall positioned leftwardly from the right rail.

6. The earth moving implement of claim 5 wherein the left and right pivot axles further respectively span between the left rail and the left inner wall and between the right rail and the right inner wall.

7. The earth moving implement of claim 4 wherein the pivotal attachments of the left and right linear motion actuators' bucket ends to the left and right arms are respectively positioned at the bucket's left and right outer walls.

8. The earth moving implement of claim 7 wherein the left and right outer walls have rearward ends, and wherein the pivotal attachments of the left and right linear motion actuators' bucket ends to the left and right arms are further respectively positioned at said rearward ends.

9. The earth moving implement of claim 8 wherein the left and right mounts respectively comprise left and right columns having upper ends, the pivotal attachments of the base ends of the left and right linear motion actuators being respectively positioned at said columns' upper ends.

10. The earth moving implement of claim 9 wherein the left and right linear motion actuators comprise hydraulic rams.

11. the earth moving implement of claim 10 wherein the left and right pivot axles reside at a first elevation wherein, upon the rotation of the bucket to the earth scooping position, the pivotal attachments of the left and right linear motion actuators' bucket ends reside at a second elevation, and wherein the first elevation is greater than the second elevation.

12. The earth moving implement of claim 3 wherein the operative connection of the wheels to the left and right rails' rearward ends comprise a first cross brace and left and right pivot legs, the first cross brace spanning between the left and right rails' rearward ends, the left and right pivot legs extending rearwardly from the first cross brace, and the wheels being rotatably mounted upon said legs.

13. The earth moving implement of claim 12 wherein the operative connection of the wheels to the left and right rails further comprises second left and right columns and second left and right hydraulic rams, the second left hydraulic ram triangulating between the left pivot leg and the second left column and the second right hydraulic ram triangulating between the right pivot leg and the second right column, said operative connection being adapted for, upon extensions and retractions of the second left and right hydraulic rams, alternatively raising, lowering, and tilting the left and right rails and the bucket.

14. The earth moving implement of claim 3 wherein the towing means' operative connection to the left and right rails' forward ends comprises a towing tongue, and a second cross brace spanning between the left and right rails' forward ends, the towing tongue being fixedly attached to and extending forwardly from the second cross brace.

15. The earth moving implement of claim 14 wherein the towing tongue is "V" configured.

* * * * *